US006719057B2

(12) United States Patent
Johansen

(10) Patent No.: US 6,719,057 B2
(45) Date of Patent: Apr. 13, 2004

(54) DOWNHOLE SUBSURFACE SAFETY VALVE DEVICE

(75) Inventor: John A Johansen, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 10/004,863

(22) Filed: Dec. 7, 2001

(65) Prior Publication Data

US 2002/0084075 A1 Jul. 4, 2002

(30) Foreign Application Priority Data

Dec. 7, 2000 (NO) ..... 20006212

(51) Int. Cl.[7] ..... E21B 34/14; E21B 34/06

(52) U.S. Cl. ..... 166/332.8; 166/66.6; 166/97.1; 166/373

(58) Field of Search ..... 166/97.4, 95.1, 166/75.13, 72, 73, 373, 386, 316, 332.1, 332.4, 332.8, 66.4, 66.6, 66.5

(56) References Cited

U.S. PATENT DOCUMENTS 2,796,133 A 6/1957 En Dean
3,726,341 A * 4/1973 Holbert, Jr. ..... 166/321
3,763,932 A * 10/1973 Dinning ..... 166/72
3,791,445 A 2/1974 True
3,815,675 A 6/1974 Peters
3,817,327 A 6/1974 Grable et al.
3,830,306 A * 8/1974 Brown ..... 166/53
4,258,786 A * 3/1981 Lochte et al. ..... 166/72
5,167,284 A * 12/1992 Leismer ..... 166/374
5,284,205 A * 2/1994 Smith ..... 166/72
5,343,955 A * 9/1994 Williams ..... 166/386
5,465,786 A * 11/1995 Akkerman ..... 166/66.4
5,862,864 A 1/1999 Whiteford
6,102,828 A * 8/2000 MacKenzie ..... 475/263
6,237,693 B1 * 5/2001 Deaton ..... 166/375
6,352,239 B1 * 3/2002 McIntosh et al. ..... 251/100
2002/0108747 A1 * 8/2002 Dietz et al. ..... 166/66.7

FOREIGN PATENT DOCUMENTS

GB 2119831 A * 11/1983 ..... E21B/34/10

* cited by examiner

*Primary Examiner*—David Bagnell
*Assistant Examiner*—Jennifer H Gay
(74) *Attorney, Agent, or Firm*—Young & Thompson

(57) ABSTRACT

A downhole subsurface safety valve device, where an actuator is mounted on the outside of the well on the Christmas tree and the valve is operated by a mechanical transmission which may be linear (an hydraulic actuator) or rotary (an electric motor).

20 Claims, 5 Drawing Sheets

DOWNHOLE SUBSURFACE SAFETY VALVE DEVICE

BACKGROUND OF THE INVENTION

The invention relates to a downhole subsurface safety valve device in an oil or gas well. The invention is particularly suitable for use in subsea wells.

DESCRIPTION OF THE RELATED ART

In an oil or gas well a barrier has to be established down in the well in order to safeguard against an uncontrolled efflux of the hydrocarbons. In the production tubing, therefore, a valve is mounted which is open during normal operation, but which can be closed if it becomes necessary to open the well, for example for a workover.

Downhole safety valves are in the form either of ball valves or flap valves. They are normally hydraulically operated by means of a hydraulic line, which extends down into the well along the tubing in order to supply hydraulic fluid to a piston in a valve actuator for opening the valve. The valves are usually arranged in such a manner that they are automatically closed when there is a loss of operating fluid.

An example of such a valve is disclosed in U.S. Pat. No. 5,862,864.

Such valves are normally very reliable. One drawback, however, is that the supply line is highly vulnerable to damage, which may be incurred down in the well. The supply line is arranged along the outside of the tubing. A leakage in the supply line causes the valve to close without the possibility of opening it again. In this case the tubing has to be removed from the well, and this is a highly complicated and expensive operation.

Solutions exist for lowering an additional valve, but it needs to have a smaller through-flow opening than the old one. Another solution is to lay the supply line in a channel inside the wall of the tubing, but this makes the tubing expensive and it is difficult to screw the pipes together so that the channels are in alignment. In addition complex seals have to be established between the pipes.

A second drawback with the present valves is that they cannot be operated manually. Valves on the Christmas tree, e.g., are equipped with manual override, thus enabling the valve to be opened or closed by means of a remotely operated subsea vessel, a so-called ROV.

Thus it is an object of the invention to provide a valve that can be operated without the use of hydraulic fluid and from the outside of the well. This is achieved by means of the present invention by a valve actuator being placed in or on the Christmas tree with a mechanical connection down to the valve's kelly bushing. The mechanical connection is a member extending in the well's longitudinal direction, which can either be moved axially or rotated in order to operate the valve.

This provides a number of advantages. For example, should a fault arise in the actuator, it can easily be replaced. A second major advantage of the invention is that the actuator can be equipped with a manual override. The valve can thereby be closed by means of an ROV in the event of failure of the actuator.

DESCRIPTION OF THE PREFERRED EMBODIMENT

Figure 1:
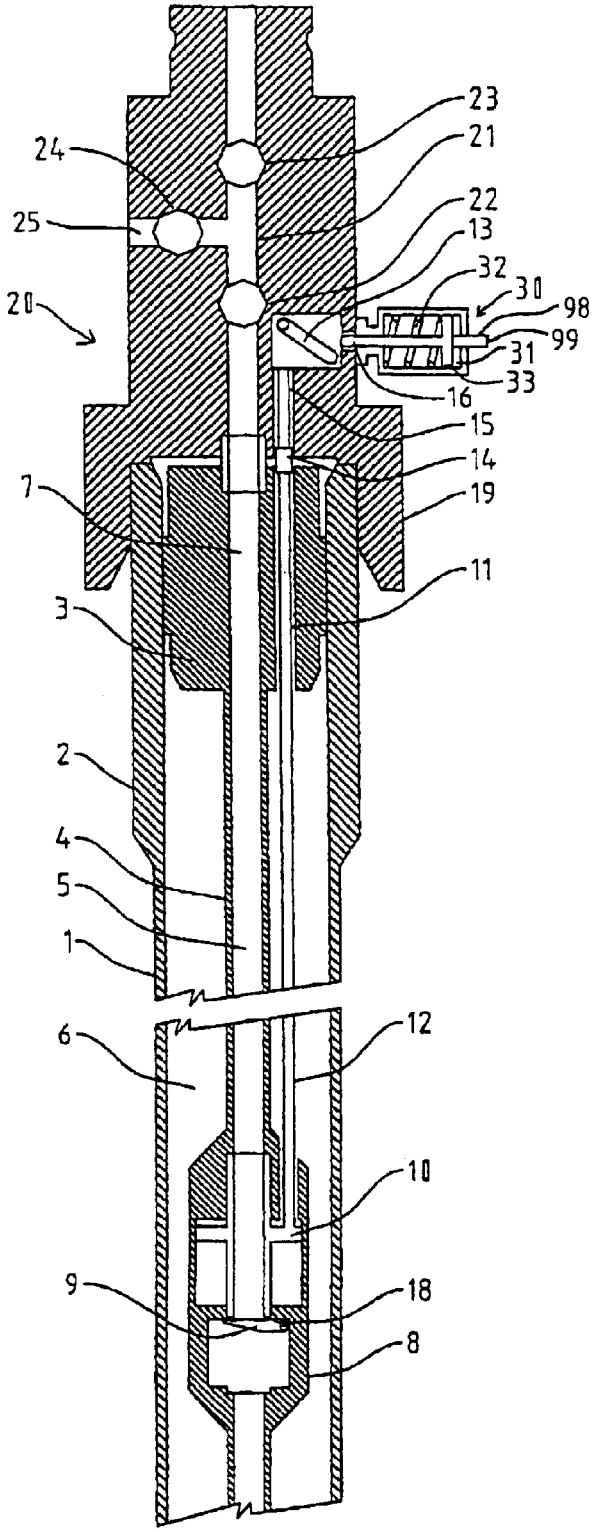
FIG. 1 is a vertical section through a conventional completion illustrating a first embodiment of the invention.

In FIG. 1 there is illustrated a well lined with a casing 1, which is cemented into a borehole (not shown). A wellhead 2 is mounted on top of the casing 1. A tubing hanger 3 is secured to the wellhead, from which tubing 4 extends down into the well. The tubing defines a channel 5 for well fluids. Between the tubing and the casing 1 is an annulus 6. In the tubing hanger 3 there is provided a first axial channel 7 in the continuation of the channel 5 and a second channel 11.

A Christmas tree 20 is releasably attached to the top of the wellhead 2 by a standard wellhead connector 19. In the Christmas tree there is provided a vertical channel 21, which extends in the extension of the channel 7 and a horizontal side channel 25, which extends from the channel 21 out through the side wall of the Christmas tree. In the vertical channel there is mounted a main valve 22 and a wing valve 23 and in the side channel 25 there is mounted a working valve 24.

The Christmas tree in FIGS. 1 (and 3) is therefore a so-called conventional Christmas tree where produced well fluid flows through the channels 5, 7 and 21 out through the top of the Christmas tree. Everything described above is part of a conventional completion of an oil or gas well and is well known to a person skilled in the art.

Into the tubing 4 is connected a valve tube piece 8 comprising a valve, which in the embodiment illustrated in FIG. 1 is a flap valve where a valve element 9 can be rotated about a hinge 18 between a horizontal position as illustrated in FIG. 1 where the valve is closed, and a vertical position (see FIG. 3) where the valve is open. A kelly bushing 10 is arranged for vertical movement, thus influencing the valve element directly for opening the valve.

A first rigid rod 12 is rigidly connected to the kelly bushing 10 of the valve 7 and extends upwardly parallel to the tubing 4 and through the channel 11. The upper end of the rod 12 is mounted in or immediately above the top of the tubing hanger 3. The rod 12 is located in the annulus 6 and may, for example, be slidably attached to the tubing 4. The upper end of the rod is provided with a connector device 14. A second rigid rod 15 is arranged in a channel or a space in the Christmas tree, which rod has at its lower end connecting bodies for releasable connection with the rod 12. At its upper end the rod 15 is connected to a rocker 13. A third rod 16, which is an actuator rod in a hydraulic actuator 30, is connected at one end to the rocker 13 and extends approximately horizontally through the wall of the Christmas tree to the outside of the Christmas tree.

The actuator 30 is bolted or attached in another manner to the outside of the Christmas tree. The actuator is of a commonly known type, comprising a housing, which defines a cylinder chamber 31 and a spring chamber 32. A piston 33 is arranged movably inside the housing. In the spring chamber is mounted a return spring, with the result that the piston is influenced to move into a specific position if there is a loss of hydraulic drive fluid.

The piston 33 is connected to the actuator rod 16. When the piston is influenced to move to drive position, i.e. to the left in FIG. 1, the rod 16 will similarly move to the left. This in turn influences the rocker element 13, with the result that the rod 15 and thereby the rod 12 are pushed downwards, thereby influencing the kelly bushing 10, causing it to open the valve.

This situation will last as long as the pressure on the piston is maintained. If a situation should arise where the pressure drops, the return spring will push the piston back to its original position, i.e. to the right in the drawing. This will cause the rod 12 and thereby the kelly bushing 10 to be pushed upwards, thus closing the valve.

To assist in closing the valve, the kelly bushing 10 may be in the form of a hydraulic piston. A bypass channel (not shown) in the pipe piece 8 causes the well pressure to act on the bottom of the kelly bushing. Since the valve element is located in an upwardly rising flow of hydrocarbons, it too will attempt to close the valve in the event of a loss of hydraulic drive fluid to the actuator.

The piston 33 in the actuator may comprise a screw rod 98, which extends out past the end of the actuator housing and comprises a connector 99 for a manual override, which can be operated by an ROV. Thus the valve can still be closed by an ROV rotating the actuator into the closed position.

Figure 2:
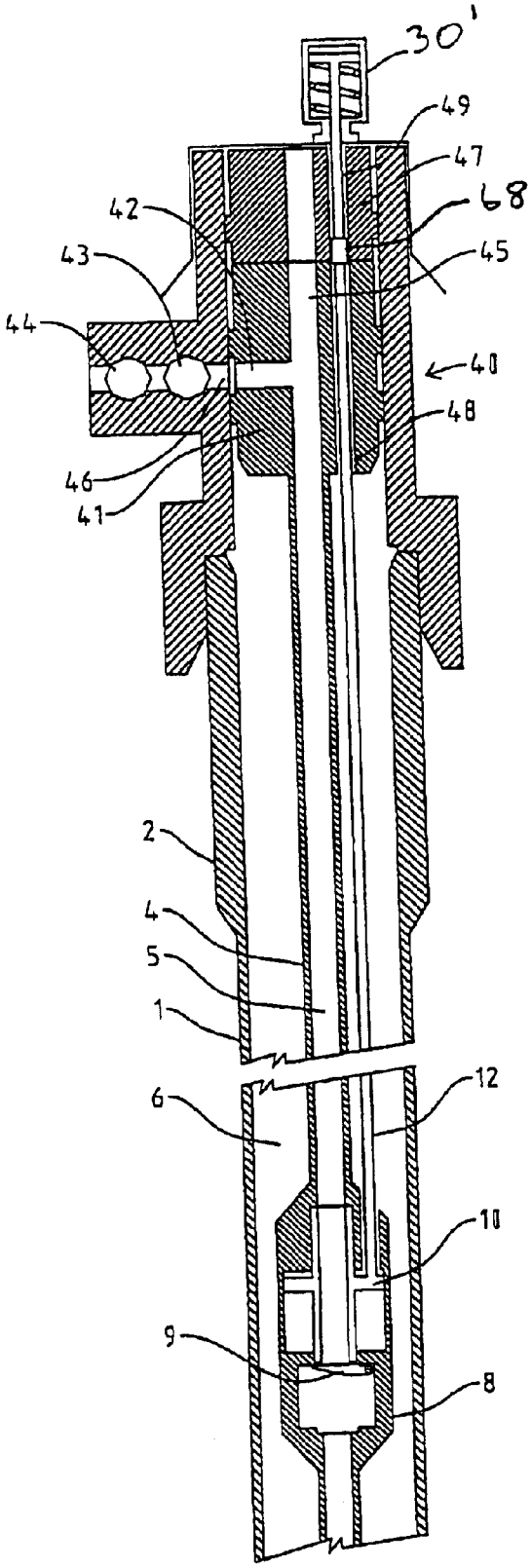
FIG. 2 is a vertical section similar to that in FIG. 1 in a horizontal Christmas tree.

In FIG. 2 a second embodiment is illustrated where the invention is employed in a horizontal Christmas tree. Identical parts have been given the same reference numerals.

The horizontal Christmas tree 40 is connected to the top of a wellhead 2 in the same way as for the conventional Christmas tree in FIG. 1. A tubing hanger 41 is mounted inside the Christmas tree from which the tubing 4 extends downwards in the well. A first vertical channel 45 is provided in the tubing hanger 41, which channel is arranged in axial extension of the tubing's channel 5. The channel 45 is normally closed at its upper end by a retractable plug (not shown), which can be removed in order to gain access to the well, for example in workover operations. A horizontal channel 42 in the tubing hanger 41 extends from the channel 45 and is connected with a channel 46 extending through the side wall of the Christmas tree. In the side channel 46 there is mounted a main valve 43 and a wing valve 44.

Above the tubing hanger an internal plug 47 is provided in the Christmas tree, but a cap (not shown) may be used instead. The plugs form barriers during normal production, thus causing produced well fluid to flow out through the channels 42 and 46.

In the tubing hanger there is provided a second axially extending channel 48. In the same way as illustrated in FIG. 1 the rod 12 extends through the channel 48, ending in a connector 68 immediately above the upper end of the tubing hanger. A second channel 49 extends through the plug 47 to receive the actuator's 30' actuator rod 16. The actuator rod is releasably connected at its lower end with the rod 12 by means of the connector 68.

The actuator 30' is placed in a vertical position on the outside of the valve casing 40 as illustrated. Otherwise the actuator is identical to the previously described actuator 30.

Figure 3:
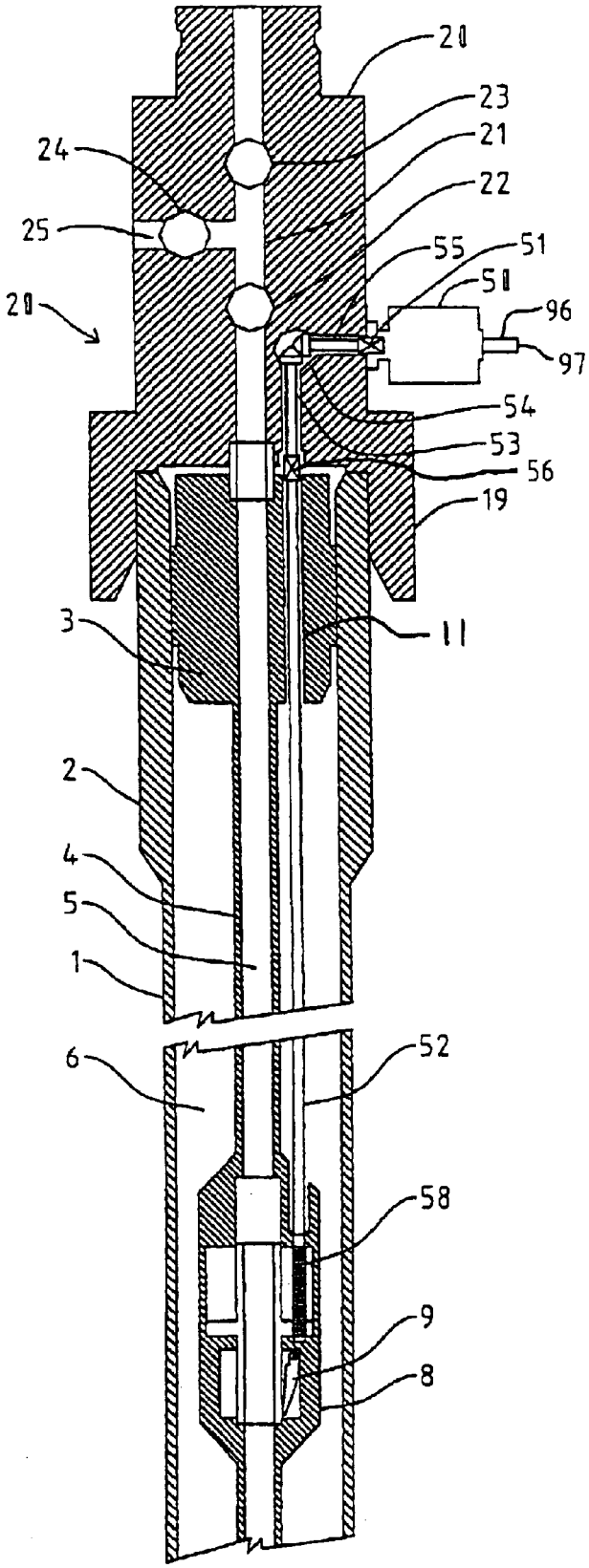
FIG. 3 is a vertical section through a conventional completion illustrating a second embodiment of the invention.

In FIG. 3 a third embodiment of the invention is illustrated employed in a conventional Christmas tree. A rotating valve actuator 50, for example an electric motor, is placed on the outside of the valve casing 20. The actuator's driving rod is attached via a reduction gear 51 to a rod 55 extending horizontally through the wall of the valve casing to a transmission 54, comprising two conical pinions. A second rod 53 is connected at its upper end to the gear 54 and at its lower end to a coupling 56.

A driving rod 52 corresponding to the rod 12 in FIG. 1 extends along the outside of the tubing 4 and through the tubing hanger's second channel 11. At its upper end the rod has means for connection to the coupling 56, which, for example, may be a spline coupling, which permits axial movement. The lower end of the rod 52 is connected to the valve's kelly bushing 10, thus enabling the rod's 52 rotation to be transferred to a translatory movement of the kelly bushing 10. The lower end of the rod may, for example, be a threaded end 58, which is engaged with a corresponding threaded pin on the kelly bushing 10.

When the actuator rotates the rod 55, the rotary motion will be transferred to the rod 52, thus enabling the valve to be opened or closed.

The motor 50 may also be a hydraulic rotary motor, which is driven by means of hydraulic fluid.

Motors of the above-mentioned type will remain in their position if the motive power disappears. The actuator will therefore not make it possible to bring the valve to closure when there is a loss of power. In order to achieve a corresponding closure-proof valve, an emergency power supply must be established, either in the form of a battery or an accumulator must be provided, which can supply power, thus enabling the valve to be closed if the power supply fails.

To assist in closing the valve its kelly bushing 10, as described in connection with FIG. 1, can be equipped with a hydraulic piston driven by well fluid. If the electric power supply fails the motor can be designed to run in "neutral", with the result that the well pressure acting on the kelly bushing's piston will be able to effect rotation of the valve's pivot so that it goes into a closed position.

The motor's 50 drive shaft 96 may be extended to the outside of the valve casing and provided with a coupling 97 for a manual override, which can be operated by an ROV. If necessary, for example in the event of motor failure, the valve can still be closed by an ROV rotating the actuator and thereby the rod 52.

Figure 4:
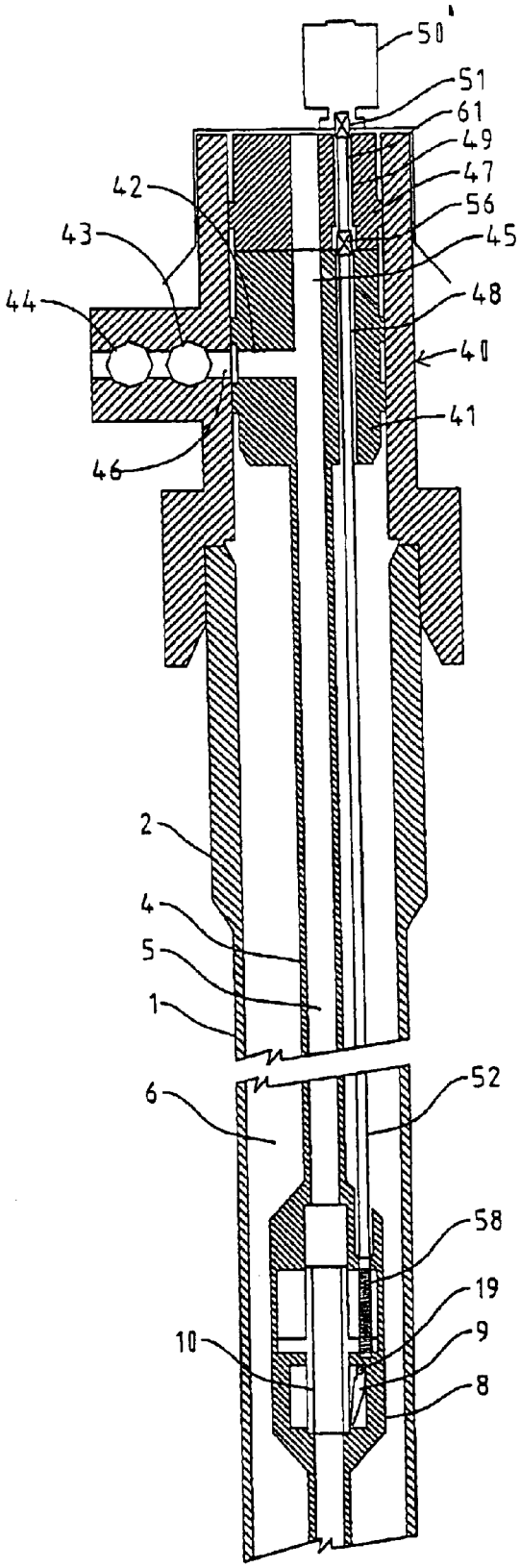
FIG. 4 is a vertical section similar to that in FIG. 3 in a horizontal Christmas tree.

In FIG. 4 a fourth embodiment of the invention is illustrated where a rotating actuator like that employed in FIG. 3 is used in a horizontal Christmas tree. Identical parts have been given the same reference numerals.

The rotating valve actuator 50' is mounted in a vertical position and placed on the outside of the valve plug 47 (cf. FIG. 2). The actuator's driving rod is attached via a reduction gear 51 to a rod 61 extending vertically through the channel 49 in the plug 47 and connected to the rotary coupling 56.

The driving rod 52 extends in the same manner along the outside of the tubing 4 and through the tubing hanger's second channel 48. In its upper end the rod has a rotary coupling 56, which may, for example, be a spline coupling, which permits axial movement. The lower end of the rod 52 is connected to the valve's kelly bushing 10 with a pinion enabling the rod's 52 rotation to be transferred to a translatory movement of the kelly bushing 10. The lower end of the rod may, for example, be a threaded end 58, which is engaged with a pin on the kelly bushing 10.

When the actuator rotates the rod 55, the rotary motion will be transferred to the rod 52, thus enabling the valve to be opened or closed.

Figure 5:
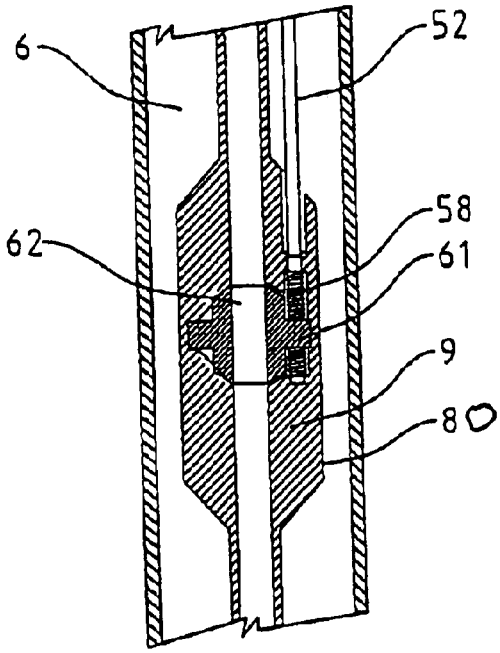
FIG. 5 is a view like that in FIG. 4, of a ball valve.

In FIG. 5 there is illustrated further embodiment where the downhole valve in valve tube piece 80 is a ball valve. Otherwise, this version corresponds to the version illustrated in FIG. 3 or 4 and therefore details illustrated therein are not shown.

At its lower end the rod 52 is equipped with threads 58. The ball valve 9 comprises a valve element 62 (ball) with an actuator pin 61. The actuator pin 61 and the rod's 52 threaded end 58 form interacting parts of a gear, with the result that rotation of the rod 52 causes rotation of the pin 61, thereby opening and closing the valve element 62. There may also be arranged bypass channels and additional auxiliary pistons, which close the valve against the well pressure, but these are well known to a person skilled in the art and are therefore not illustrated in further detail.

Additional modifications will be natural for a person skilled in the art within the scope of the invention. For example, the valve will be able to be activated by tension in the longitudinal member, rod 12 and 52 respectively instead of compression. In that case a tension element may be used as the longitudinal member, i.e. a cable, rope, wire or likewise.

What is claimed is:

1. A downhole subsurface safety valve device, comprising:

a valve element (8;80) inserted in a production tubing (4) in a well a distance below the well's Christmas tree (20;40), an actuator (30;30';50;50') for operation of the valve, and a connecting device mechanically connecting the actuator and the valve element, wherein, in that the actuator (30;30';50) is mounted on the outside of the Christmas tree and the connecting device (12;52) is a non-hydraulic longitudinal member which extends through the tubing's pipe hanger (3;41) and along the outside of the tubing (4).

2. A device according to claim 1, wherein the longitudinal member (12;52) is a rod.

3. A device according to claim 1, wherein the actuator (30;30') is a hydraulic actuator.

4. A device according to claim 3, wherein the actuator comprises a device for manual operation of the valve by an ROV.

5. A device according to claim 1, wherein the actuator (50;50') is an electric actuator.

6. A device according to claim 5, wherein the longitudinal member is a rod (12) is connected to the actuator by a rocker (13).

7. A device according to claim 5, wherein the rod (12;52) is connected to the actuator by a spline connection (56).

8. A device according to claim 5, wherein the actuator comprises a device for manual operation of the valve by an ROV.

9. A device according to claim 1, wherein the actuator comprises a device for manual operation of the valve by an ROV.

10. A device according to claim 9, wherein the longitudinal member is a shaft (52) connected to the actuator by a rotary transmission (54).

11. A device according to claim 9, wherein the rod (12;52) is connected to the actuator by a spline connection (56).

12. A device according to claim 1, wherein the longitudinal member (12;52) is a shaft.

13. A downhole subsurface safety valve device, comprising:

a valve element inserted, in use, in a production tubing in a well at a distance below a well Christmas tree;

a rigid non-hydraulic longitudinal member connected, at a first end, to the valve element; and an actuator connected to a second end of the rigid member, the actuator being mechanically linked to the valve element via the rigid member and configured to mechanically control the valve through the mechanical connection with the rigid member, the actuator being accessible externally to the Christmas tree.

14. The device of claim 13, wherein, the rigid member is a rigid rod, and the valve element comprises:

a flap valve;

a hinge between connected to the flap valve;

a kelly bushing connected to the flap valve and to the rigid rod, the flap valve movable between a closed horizontal position and an open position by the actuator mechanically causing the rigid rod to vertically move the kelly bushing.

15. The device of claim 13, wherein the actuator comprises a screw rod extending outside a body of the actuator and providing an external manual override operable to open and close the valve element.

16. The device of claim 13, wherein the actuator comprises an electric motor with a drive shaft extending outside a body of the actuator, the extending drive shaft providing an external manual override operable to open and close the valve element.

17. A downhole subsurface safety valve device, comprising:

a valve tube piece inserted, in use, in a well production tubing at a distance below a well Christmas tree, the valve tube piece comprising a valve mechanically operable to open and close off flow through the well production tubing;

an actuator, accessible externally to the Christmas tree, for opening and closing the valve; and a non-hydraulic vertical rigid member operatively connected, at a first end, to the valve and operatively connected, at a second end, to the actuator, the rigid member mechanically linking the valve and actuator.

18. The device of claim 17, wherein, the rigid member is a rod; and the actuator comprises a rocker arm connected to an upper end of the rod, an actuator rod connected to the rocker arm, and a means for moving the actuator rod to causing the rocker arm to move the rod to open and close the valve.

19. The device of claim 17, wherein, the rigid member is a rod terminating with a first pinion; and the actuator comprises an actuator rod terminating with a second pinion, the first pinion engaged with the second pinion.

20. The device of claim 19, wherein the actuator further comprises a reduction gear attached to the actuator rod, and an electric motor attached to the reduction gear.

* * * * *